US008077108B2

(12) United States Patent
Chao

(10) Patent No.: US 8,077,108 B2
(45) Date of Patent: Dec. 13, 2011

(54) DIGITAL TV ANTENNA WITH TWO CONDUCTIVE SURFACES

(76) Inventor: Albert Chao, Saddle River, NJ (US)

( * ) Notice: Subject to any disclaimer, the term of this patent is extended or adjusted under 35 U.S.C. 154(b) by 572 days.

(21) Appl. No.: 12/330,674

(22) Filed: Dec. 9, 2008

(65) Prior Publication Data

US 2010/0141544 A1 Jun. 10, 2010

(51) Int. Cl.
*H01Q 9/28* (2006.01)

(52) U.S. Cl. ..... 343/795

(58) Field of Classification Search ..... 343/795, 343/895, 793, 850

See application file for complete search history.

(56) References Cited

U.S. PATENT DOCUMENTS 6,917,335 B2 * 7/2005 Kadambi et al. ..... 343/700 MS
7,498,995 B2 * 3/2009 Kim et al. ..... 343/770
7,639,186 B2 * 12/2009 Chang ..... 343/700 MS
7,898,483 B2 * 3/2011 Chen et al. ..... 343/700 MS
2003/0107518 A1 * 6/2003 Li et al. ..... 343/702
2006/0181471 A1 * 8/2006 Kim et al. ..... 343/767
2007/0046557 A1 * 3/2007 Chen et al. ..... 343/795
2007/0080890 A1 * 4/2007 Yang et al. ..... 343/895
2009/0096677 A1 * 4/2009 Chang ..... 343/700 MS
2009/0207086 A1 * 8/2009 Shinkawa et al. ..... 343/793
2011/0037655 A1 * 2/2011 Tsai et al. ..... 343/700 MS

* cited by examiner

*Primary Examiner* — Huedung Mancuso
(74) *Attorney, Agent, or Firm* — Notaro, Michalos & Zaccaria P.C.

(57) ABSTRACT

A digital TV antenna has first and second conductive members with surfaces of two minimum orthogonal dimensions and a nonconductive substrate connected to the surfaces of the conductive members for supporting them at a spaced location from each other of not more than ½ inch. Wires electrically connect the conducive members to a plug for being plugged to an input of a digital TV and at least one of the two minimum orthogonal dimensions is at least eight inches.

17 Claims, 6 Drawing Sheets

DIGITAL TV ANTENNA WITH TWO CONDUCTIVE SURFACES

FIELD AND BACKGROUND OF THE INVENTION

The present invention relates generally to the field of antennas, and in particular to a new and useful digital TV antenna that is made of two conductive surfaces that are separated by a nonconductive substrate.

A wide variety of TV antennas are known but all are complicated, often power structures, or are large elongated structures.

SUMMARY OF THE INVENTION

It is an object of the present invention to provide a digital TV antenna that is small, passive (i.e. unpowered) and simple, while being very efficient at picking up digital TV signals that are typically in the frequency range of 470 to 860 MHz.

It is another object of the present invention to provide a digital TV antenna that has a first conductive member with a substantially continuous digital signal receiving surface with two minimum orthogonal dimensions, a second conductive member with a substantially continuous digital signal receiving surface with two minimum orthogonal dimensions, a first conductive wire having a first end electrically connected to the first conducive member and an opposite end, a second conductive wire having a first end electrically connected to the second conductive member and an opposite end, a plug connected to the opposite ends of the first and second conductive wires for being plugged to an input of a digital TV, and a nonconductive substrate connected to the surfaces of each of the first and second conductive members for supporting the conductive members at a spaced location from each other by a selected spacing. At least one of the two minimum orthogonal dimensions for each conductive member is at least about eight inches but may advantageously be about eight to about eighteen inches with a spacing between the conductive members being preferable 1/64th to 1/2 inch, whether they are face to face on opposite sides of the nonconductive substrate, or side by side on the same side if the nonconductive substrate. Large spacing will also work however.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
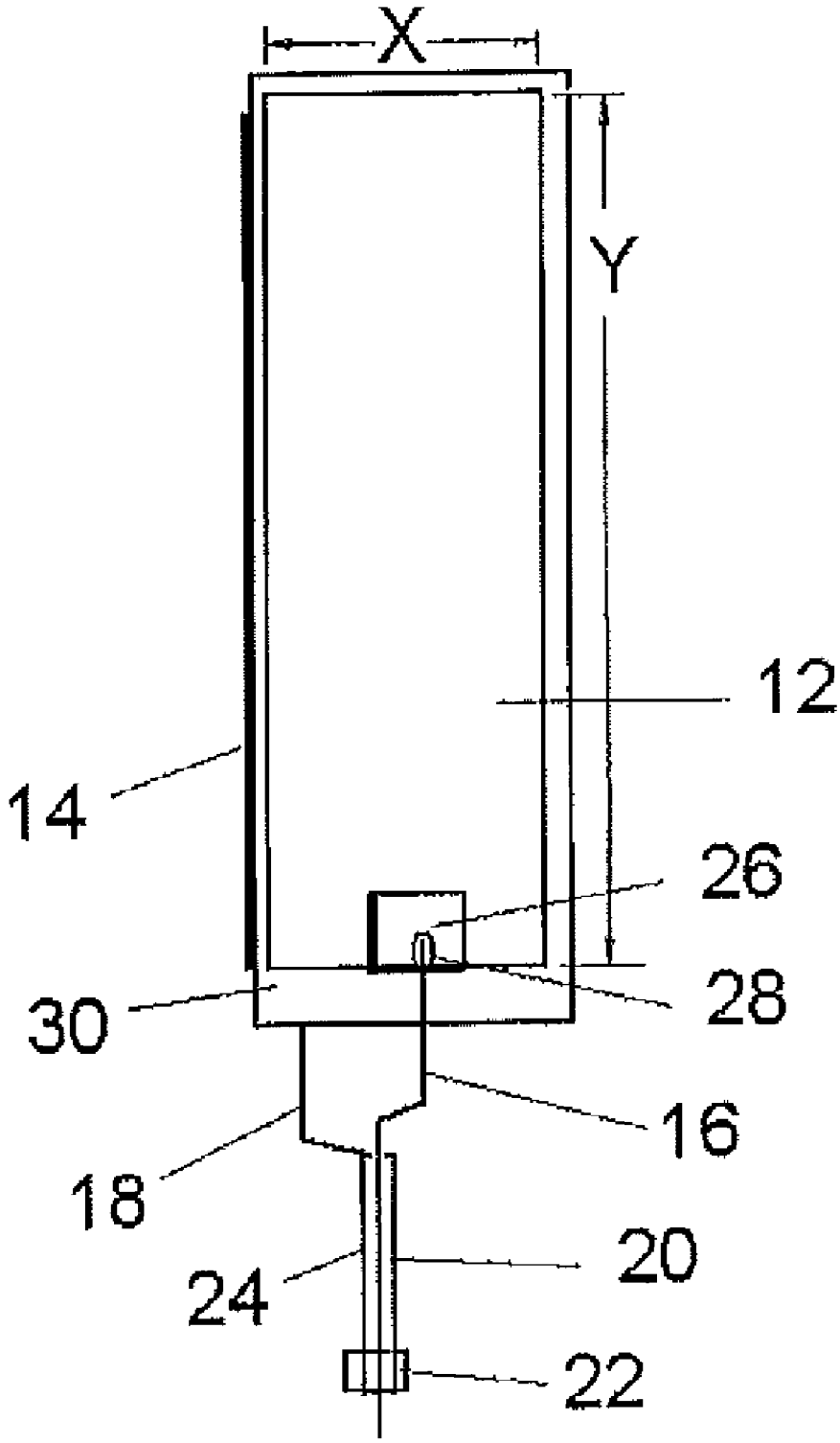
FIG. 1 is a perspective view of an embodiment of the invention.

Referring now to the drawings, in which like reference numerals are used to refer to the same or similar elements, FIG. 1 shows a digital TV antenna of the invention comprising a first conductive member 12 having a substantially continuous digital signal receiving surface with two minimum orthogonal dimensions X and Y and a second conductive member 14 having a substantially continuous digital signal receiving surface with two minimum orthogonal dimensions X and Y.

The orthogonal dimensions and, preferably, the size and shape of the first and second conductive members are substantially the same, although they may be slightly different from each other.

The antenna includes a first conductive wire 16 that has a first end electrically connected to the first conducive member 12, and an opposite end forming or connected as the center conductive (e.g. copper) core of a coaxial cable 20, and acting as the center contact of an F type or RG6 or other coaxial TV plug 22. A second conductive wire 18 having a first end electrically connected to the second conductive member 14, also has an opposite end connected to the shielding conductive braiding 24 of the cable 22 and electrically connected to the screw cap for the plug 22.

The plug 22 is for connection to an input of a digital TV and the first and second conductive member 12 and 14 are preferably made of aluminum or aluminum alloy, or they can alternatively be made of copper. Since it is not possible to solder to aluminum, to electrically connect the first ends of the wires 16 and 18 to the conductive members 12 and 14, is the members are not copper, then a copper pad 26 is electrically and mechanically connected to the surface of each conductive member, e.g. by being mechanically fastened to the member or by being deposited on the surface, e.g. by vapor or other deposition. The ends of the wires can therefore by soldered at 28 to each pad.

The antenna also includes a nonconductive substrate 30 connected, e.g. by two-sided tape, adhesives, fusing, ultrasonic welding or other means, to the surfaces of each of the first and second conductive members 12 and 14, for supporting the conductive members at a spaced location from each other by a selected spacing and in a manner that insulates the conductive members from each other.

At least one of the two minimum orthogonal dimensions X and Y for each conductive member has been found to advantageously be at least about eight (8) inches for best digital TV reception but can be up to eighteen (18) inches. Large sizes yield no better reception but become awkward and unwieldy.

Although shown to be rectangular in FIG. 1, each of the first and second conductive members 12 and 14 can be of another polygonal shape such as triangular, pentagonal, hexagonal, heptagonal (seven-sided), octagonal or any other sided, or ovoid including circular and oval as well as semi-circular and semi-oval, or may have any other shape as long as there is sufficient substantially continuous surface area to pick up the digital signal. Within the meaning of the term substantially continuous for the conductive members 12 and 14, are surfaces that have small perforations or patterns of holes, grooves or slots in them.

As illustrated in FIG. 1, the first and second conductive members 12 and 14 are shown to be rectangular and their surfaces are face to face on opposite sides of the nonconductive substrate 30 so that the surfaces of the first and second conductive members are spaced from each other by the thickness of the nonconductive substrate that is less than about ½ inch but preferable about 1/64th to ½ inch thick. The nonconductive substrate may be paper, cardboard, plastic or any other preferably but not necessarily, rigid flat material that can support and separate the conductive members 12 and 14.

Figure 4:
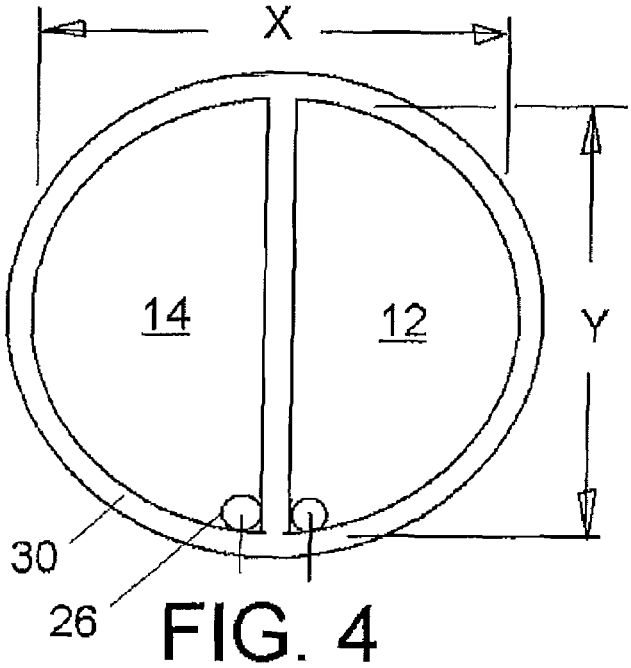
FIG. 4 is a front elevational view of a still further embodiment of the invention.

For the purpose of this disclosure the word rectangular is meant to include both square, where the maximum, orthogonal dimensions are equal to each other, and non-square rectangles where the maximum, orthogonal dimensions are not equal to each other, and the word ovoid is meant to include both circular, where the maximum, orthogonal dimensions (i.e. the diameter in the X and Y directions) are equal to each other, and oval where the maximum, orthogonal dimensions (i.e. the major and minor axial dimensions in the X and Y directions) are not equal to each other, as well as semi-circular and semi-oval as in the embodiment of FIG. 4.

Figure 2:
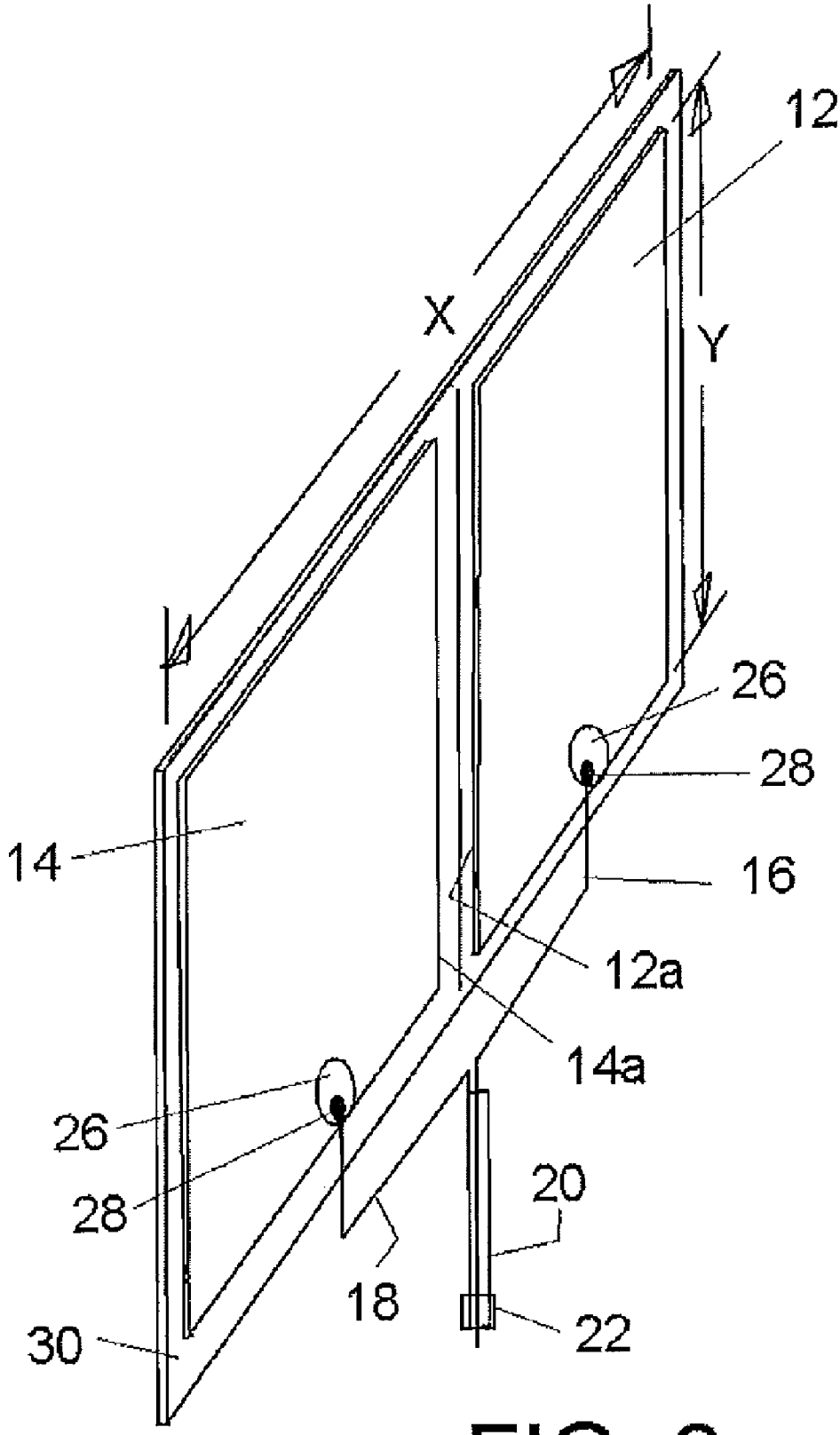
FIG. 2 is a perspective view of another embodiment of the invention.

A shown in FIG. 2 each of the first and second conductive members 12 and 14 is rectangular and the surfaces of the first and second conductive members are side by side on the same side of the nonconductive substrate 30 so that the surfaces of the first and second conductive members have adjacent edges 12*a* and 14*a* that are spaced from each other by less than about ½ inch or as little are 1/64th inch. Two-sided tape, adhesives, fusing, ultrasonic welding or other means are used to connect the members 12 and 14 to the surface of substrate 30.

Figure 3:
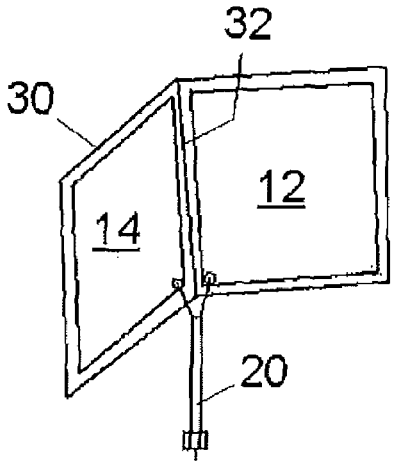
FIG. 3 is a perspective view of the embodiment of FIG. 2 is a different orientation.
Figure 7:
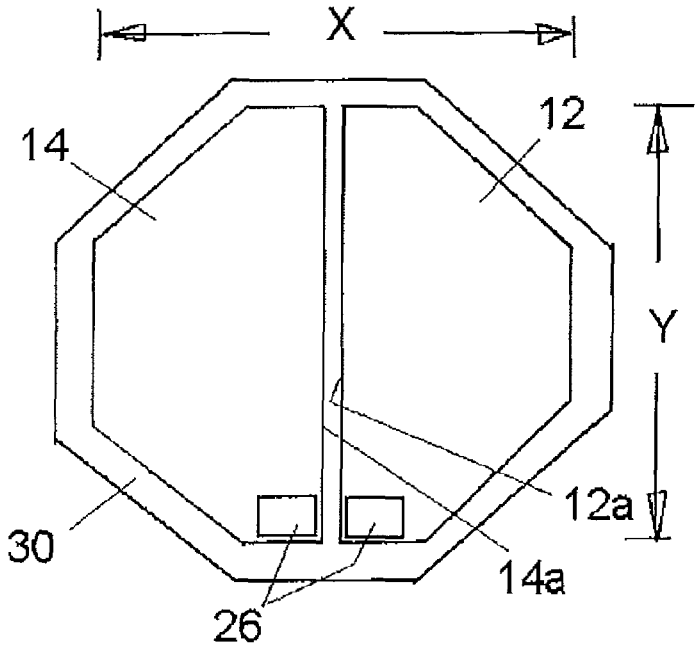
FIG. 7 is a front elevational view of a still further embodiment of the invention.

In this side by side orientation, that is also illustrated in the embodiments of FIGS. 4, 3, and 7, the first orthogonal dimension X is a total of at least about eight inches so that each separate member 12 and 14 has an X direction dimension of at least about four inches, and a Y direction dimension of at least eight inches.

Figure 5:
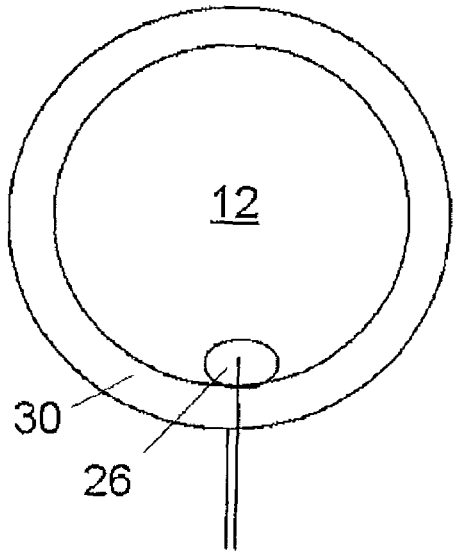
FIG. 5 is a front elevational view of a further embodiment of the invention.

FIGS. 4 and 5 show embodiments of the invention where the shape of the conductive members is ovoid and they are in face to face orientation as in FIG. 5 or in side by side orientation as in FIG. 4.

FIG. 3 illustrates an embodiment of the invention that is like the embodiment of FIG. 2, but with a fold line 32 in substrate 30 between the conductive members 12 and 14, so that the antenna can be folded into a V-shaped configuration so that it can stand on a horizontal surface, such as a counter top that also carries the digital TV, but perhaps in a hidden location behind the TV.

Figure 8:
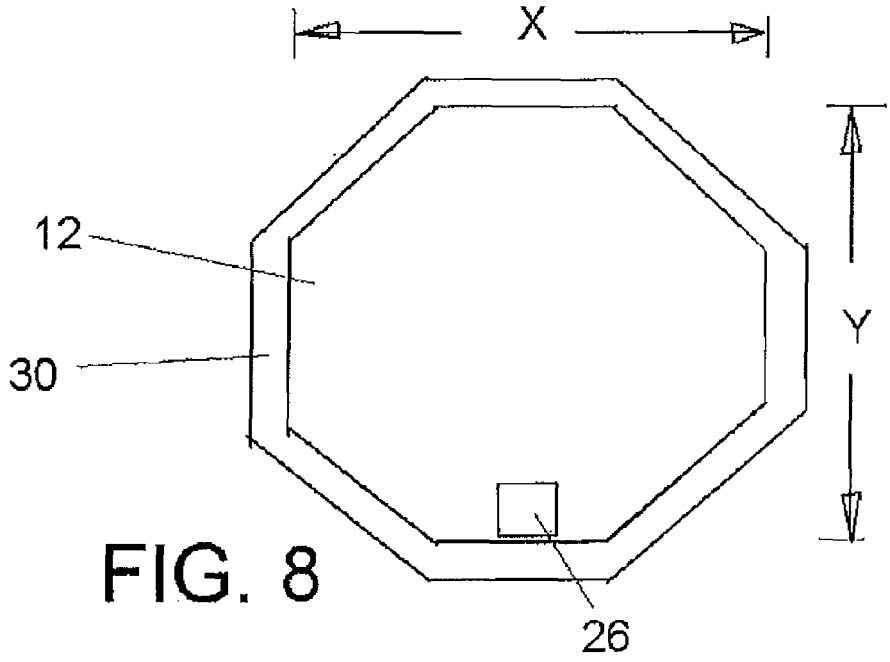
FIG. 8 is a front elevational view of a further embodiment of the invention.

FIGS. 7 and 8 illustrate polygonal embodiments of the invention in side by side and face to face arrangements respectively.

A shown the embodiments of FIGS. 2, 4 and 7, the digital TV antenna that has first and second conductive members 12, 14, that are polygonal or ovoid, or semi-versions of the base shape, with surfaces that are side by side on the same side of the nonconductive substrate 30 so that the surfaces of the first and second conductive members have adjacent edges that are spaced from each other, also utilize conductive members having a mirror symmetrical shapes, each shape starting at the adjacent edges 12*a* and 14*a* of the member and extending out along the substrate.

Figure 6:
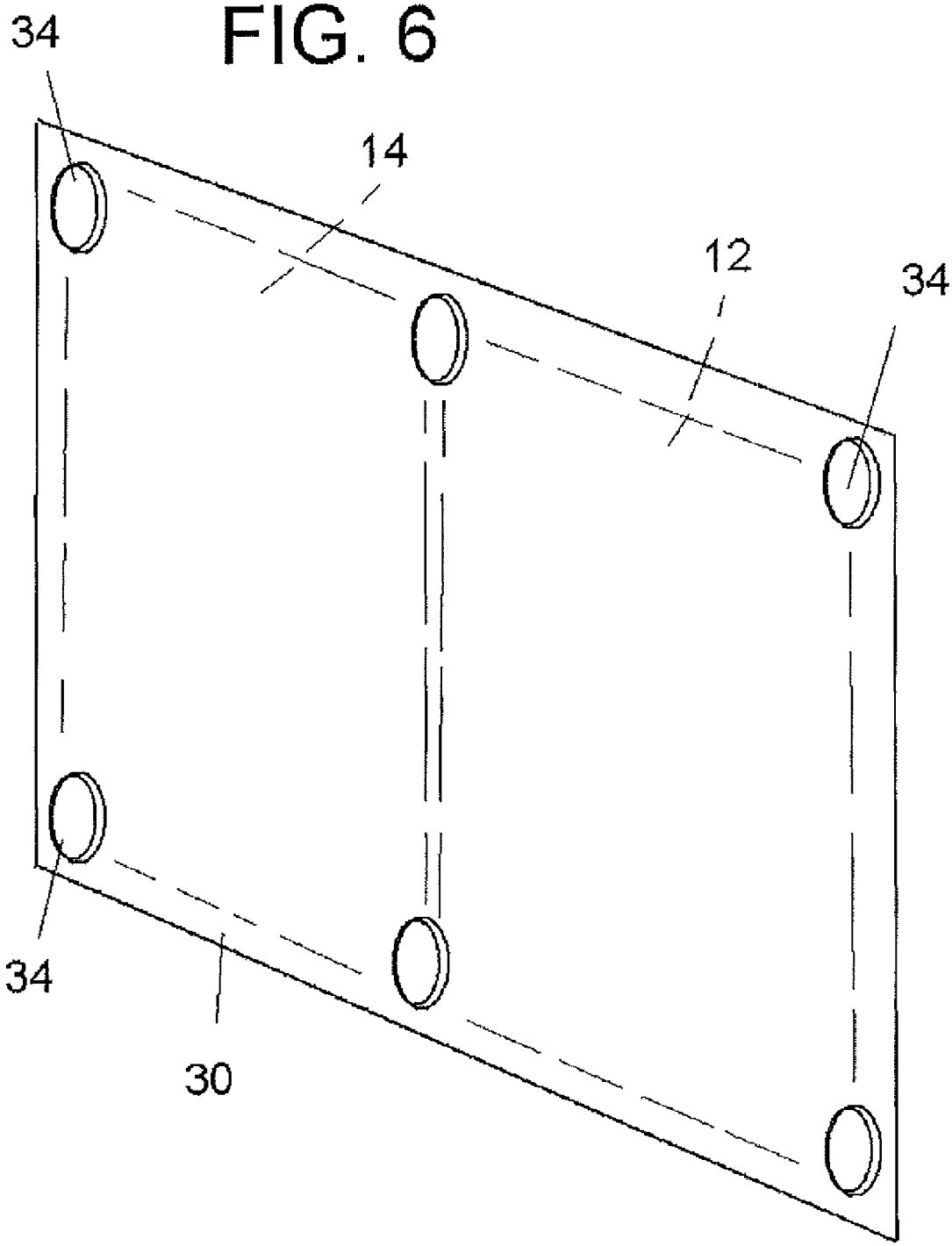
FIG. 6 is rear perspective view of the embodiment of FIG. 2 in another orientation.

As shown in FIG. 6, any flat embodiment of the invention, either the side by side version shown, or the face to face version of FIGS. 1, 5 and 8, can be mounted to the wall simply by applying two-sided tape pads 34 at spaced locations on the antenna surface and using the pads to stick the very light weight antenna of the invention to the wall or to any vertical, or even horizontal, surface.

Figure 9:
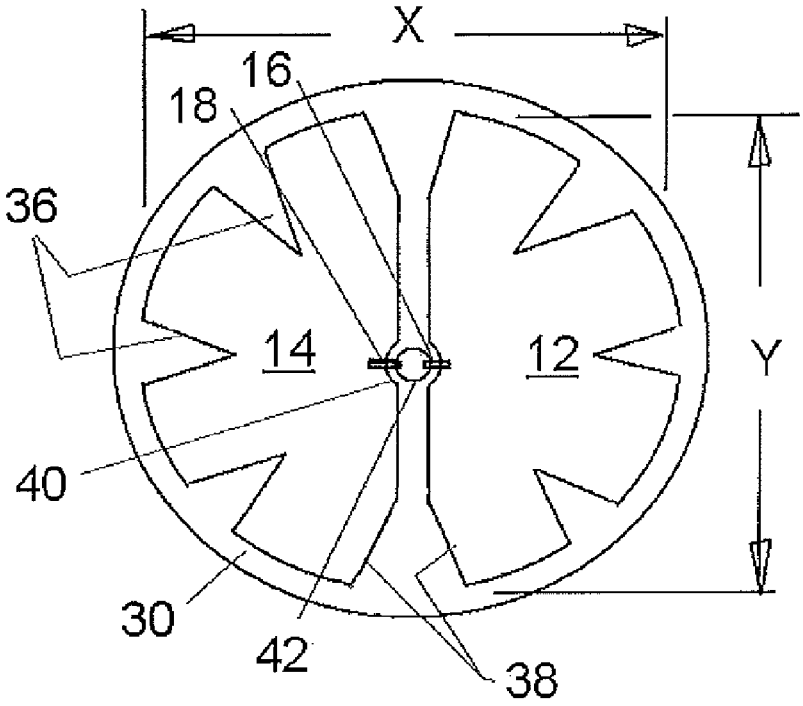
FIG. 9 is a front elevational view of a further embodiment of the invention.

FIG. 9 shows an embodiment of the invention that is similar to that of FIG. 4, except that the conductive members have V-shaped grooves 36 or angle cuts 38 spaced around the perimeters of the members 12 and 14 and in the space between them. Nonconductive substrate 30 is also designed to rotate around its central hole 42. The ends of wires 16 and 18 are electrically and mechanically connected to the members 12 and 14 near semicircular cutouts 40 in members 12 and 14 on opposite sides of the hole 42, and the wires are connected to contact rings that allow the antenna to rotate with respect to the cable 20 and plug 22. The inventor have found that with the antenna laying horizontally, the substrate 30 can be slowly rotated about a vertical axis to improve the digital TV signal. This may be due to the directional quality of the antenna resulting from the placement, shape and spacing of the side by side members 12 and 14, and their grooves and angle cuts 36 and 38.

Figure 10:
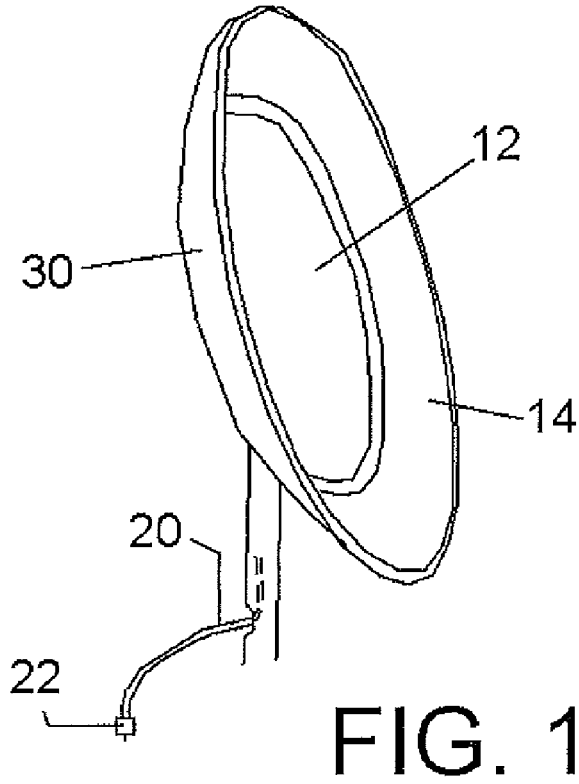
FIG. 10 is a side perspective view of another embodiment of the invention.

FIG. 10 illustrates an embodiment of the invention where the nonconductive substrate 30 is not flat but is dish-shaped with a shallow concave inner surface for the conductive members 12 and 14. The first and second conductive members 12 and 14 are concentric with the central member 12 being connected to the core wire 16 and the outer rim member 14 being connected the ground wire 18 of the cable 20. The embodiment has also been found to have directional qualities for improving the quality of the TV signal by moving the substrate 30 to aim in different directions. Reversing the connects in cable 20 also works but not as well.

Other flat and non-flat substrate and conductive shapes, spacing, orientation and relationships also work as an antenna.

The major shift from conventional TV antennas represented by the present invention is that while elongated conductive members, from single telescoping sticks, to rabbit eyes, to complex multi-part antenna arrays was considered the proper TV antenna shape, the inventor has discovered that two broad conductive surface areas work better for receiving digital TV signals.

While specific embodiments of the invention have been shown and described in detail to illustrate the application of the principles of the invention, it will be understood that the invention may be embodied otherwise without departing from such principles.

What is claimed is:

1. A digital TV antenna comprising:

a first conductive member having a substantially continuous digital signal receiving surface with two minimum orthogonal dimensions;

a second conductive member having a substantially continuous digital signal receiving surface with two minimum orthogonal dimensions;

a first conductive wire having a first end electrically connected to the first conducive member and an opposite end;

a second conductive wire having a first end electrically connected to the second conductive member and an opposite end;

a plug connected to the opposite ends of the first and second conductive wires for being plugged to an input of a digital TV; and a nonconductive substrate connected to the surfaces of each of the first and second conductive members for supporting the conductive members at a spaced location from each other;

at least one of the two minimum orthogonal dimensions for each conductive member being at least about eight inches; and wherein each of the first and second conductive members is rectangular and the surfaces of the first and second conductive members are face to face on opposite sides of the nonconductive substrate so that the surfaces of the first and second conductive members are spaced from each other by a thickness of the nonconductive substrate that is less than about ½ inch.

2. The digital TV antenna according to claim 1, wherein each of the first and second conductive members are aluminum or aluminum alloy and include a copper pad electrically and mechanically connected to the conductive member, the first end of the first and second wires being soldered to the copper pad of the respective conductive member.

3. A digital TV antenna comprising:

a first conductive member having a substantially continuous digital signal receiving surface with two minimum orthogonal dimensions;

a second conductive member having a substantially continuous digital signal receiving surface with two minimum orthogonal dimensions;

a first conductive wire having a first end electrically connected to the first conducive member and an opposite end;

a second conductive wire having a first end electrically connected to the second conductive member and an opposite end;

a plug connected to the opposite ends of the first and second conductive wires for being plugged to an input of a digital TV; and a nonconductive substrate connected to the surfaces of each of the first and second conductive members for supporting the conductive members at a spaced location from each other;

at least one of the two minimum orthogonal dimensions for each conductive member being at least about eight inches; and wherein each of the first and second conductive members is ovoid and the surfaces of the first and second conductive members are face to face on opposite sides of the nonconductive substrate so that the surfaces of the first and second conductive members are spaced from each other by a thickness of the nonconductive substrate that is less than about ½ inch.

4. The digital TV antenna according to claim 3, wherein each of the first and second conductive members are aluminum or aluminum alloy and include a copper pad electrically and mechanically connected to the conductive member, the first end of the first and second wires being soldered to the copper pad of the respective conductive member.

5. A digital TV antenna comprising:

a first conductive member having a substantially continuous digital signal receiving surface with two minimum orthogonal dimensions;

a second conductive member having a substantially continuous digital signal receiving surface with two minimum orthogonal dimensions;

a first conductive wire having a first end electrically connected to the first conducive member and an opposite end;

a second conductive wire having a first end electrically connected to the second conductive member and an opposite end;

a plug connected to the opposite ends of the first and second conductive wires for being plugged to an input of a digital TV; and a nonconductive substrate connected to the surfaces of each of the first and second conductive members for supporting the conductive members at a spaced location from each other;

at least one of the two minimum orthogonal dimensions for each conductive member being at least about eight inches; and wherein each of the first and second conductive members is ovoid and the surfaces of the first and second conductive members are side by side on the same side of the nonconductive substrate so that the surfaces of the first and second conductive members have adjacent edges that are spaced from each other, the first and second conductive members together having a perimeter with a plurality of grooves in the members, spaced around the perimeter.

6. The digital TV antenna according to claim 5, wherein each of the first and second conductive members are aluminum or aluminum alloy and include a copper pad electrically and mechanically connected to the conductive member, the first end of the first and second wires being soldered to the copper pad of the respective conductive member.

7. A digital TV antenna comprising:

a first conductive member having a substantially continuous digital signal receiving surface with two minimum orthogonal dimensions;

a second conductive member having a substantially continuous digital signal receiving surface with two minimum orthogonal dimensions;

a first conductive wire having a first end electrically connected to the first conducive member and an opposite end;

a second conductive wire having a first end electrically connected to the second conductive member and an opposite end;

a plug connected to the opposite ends of the first and second conductive wires for being plugged to an input of a digital TV; and a nonconductive substrate connected to the surfaces of each of the first and second conductive members for supporting the conductive members at a spaced location from each other;

at least one of the two minimum orthogonal dimensions for each conductive member being at least about eight inches; and wherein each of the first and second conductive members is polygonal and the surfaces of the first and second conductive members are face to face on opposite sides of the nonconductive substrate so that the surfaces of the first and second conductive members are spaced from each other by a thickness of the nonconductive substrate that is less than about ½ inch.

8. The digital TV antenna according to claim 7, wherein each of the first and second conductive members are aluminum or aluminum alloy and include a copper pad electrically and mechanically connected to the conductive member, the first end of the first and second wires being soldered to the copper pad of the respective conductive member.

9. A digital TV antenna comprising:

a first conductive member having a substantially continuous digital signal receiving surface with two minimum orthogonal dimensions;

a second conductive member having a substantially continuous digital signal receiving surface with two minimum orthogonal dimensions;

a first conductive wire having a first end electrically connected to the first conducive member and an opposite end;

a second conductive wire having a first end electrically connected to the second conductive member and an opposite end;

a plug connected to the opposite ends of the first and second conductive wires for being plugged to an input of a digital TV; and a nonconductive substrate connected to the surfaces of each of the first and second conductive members for supporting the conductive members at a spaced location from each other;

at least one of the two minimum orthogonal dimensions for each conductive member being at least about eight inches; and wherein:

each of the first and second conductive members is one: of polygonal, rectangular, and ovoid;

each of the first and second conductive members are one of: side by side on the same side of the nonconductive substrate so that the surfaces of the first and second conductive members have adjacent edges that are spaced from each other by about 1/64th to 1/2 inch, and face to face on opposite sides of the nonconductive substrate so that the surfaces of the first and second conductive members are spaced from each other by a thickness of the nonconductive substrate that is about 1/64th to 1/2 inch;

the two minimum orthogonal dimensions of the first and second conductive members being about eight to about eighteen inches.

10. The digital TV antenna according to claim 9, wherein each of the first and second conductive members are aluminum or aluminum alloy and include a copper pad electrically and mechanically connected to the conductive member, the first end of the first and second wires being soldered to the copper pad of the respective conductive member.

11. A digital TV antenna comprising:

a first conductive member having a substantially continuous digital signal receiving surface with two minimum orthogonal dimensions of about eight to about eighteen inches;

a second conductive member having a substantially continuous digital signal receiving surface with two minimum orthogonal dimensions of about eight to about eighteen inches;

a first conductive wire having a first end electrically connected to the first conducive member and an opposite end;

a second conductive wire having a first end electrically connected to the second conductive member and an opposite end;

a plug connected to the opposite ends of the first and second conductive wires for being plugged to an input of a digital TV; and a nonconductive substrate connected to the surfaces of each of the first and second conductive members for supporting the conductive members at a spaced location from each other by a selected spacing;

at least one of the two minimum orthogonal dimensions for each conductive member being at least about eight inches;

wherein each of the first and second conductive members is polygonal and the surfaces of the first and second conductive members are face to face on opposite sides of the nonconductive substrate so that the surfaces of the first and second conductive members are spaced from each other by a thickness of the nonconductive substrate that is about 1/64 to about 1/2 inch.

12. The digital TV antenna according to claim 11, wherein each of the first and second conductive members are aluminum or aluminum alloy and include a copper pad electrically and mechanically connected to the conductive member, the first end of the first and second wires being soldered to the copper pad of the respective conductive member.

13. The digital TV antenna according to claim 11, wherein the second conductive member is concentrically space from and around the first conductive member and each of the first and second conductive members are on the same side of the nonconductive substrate so that the surfaces of the first and second conductive members have adjacent circular edges that are spaced from each other.

14. The digital TV antenna according to claim 11, wherein the nonconductive substrate is dish shaped, the second conductive member being concentrically space from and around the first conductive member and each of the first and second conductive members are on the same side of the nonconductive substrate so that the surfaces of the first and second conductive members have adjacent circular edges that are spaced from each other.

15. A digital TV antenna comprising:

a first conductive member having a substantially continuous digital signal receiving surface with two minimum orthogonal dimensions of about eight to about eighteen inches;

a second conductive member having a substantially continuous digital signal receiving surface with two minimum orthogonal dimensions of about eight to about eighteen inches;

a first conductive wire having a first end electrically connected to the first conducive member and an opposite end;

a second conductive wire having a first end electrically connected to the second conductive member and an opposite end;

a plug connected to the opposite ends of the first and second conductive wires for being plugged to an input of a digital TV; and a nonconductive substrate connected to the surfaces of each of the first and second conductive members for supporting the conductive members at a spaced location from each other by a selected spacing;

at least one of the two minimum orthogonal dimensions for each conductive member being at least about eight inches;

wherein each of the first and second conductive members is polygonal and the surfaces of the first and second conductive members are side by side on the same side of the nonconductive substrate so that the surfaces of the first and second conductive members have adjacent edges that are spaced from each other by about 1/64th to 1/2 inch.

16. The digital TV antenna according to claim 15, wherein each of the first and second conductive members are aluminum or aluminum alloy and include a copper pad electrically and mechanically connected to the conductive member, the first end of the first and second wires being soldered to the copper pad of the respective conductive member.

17. The digital TV antenna according to claim 16, wherein the second conductive member is concentrically space from and around the first conductive member and each of the first and second conductive members are on the same side of the nonconductive substrate so that the surfaces of the first and second conductive members have adjacent circular edges that are spaced from each other.

* * * * *